United States Patent [19]

Vaughan

[11] 4,325,792

[45] Apr. 20, 1982

[54] PURIFICATION PROCESS

[76] Inventor: Daniel J. Vaughan, 36 Paxon Dr., Wilmington, Del. 19803

[21] Appl. No.: 241,520

[22] Filed: Mar. 9, 1981

[51] Int. Cl.[3] ..... C25D 21/18

[52] U.S. Cl. ..... 204/151; 204/89; 204/130; 204/DIG. 13

[58] Field of Search ..... 204/180 P, 301, 130, 204/151, DIG. 13, 89, 97

[56] References Cited

U.S. PATENT DOCUMENTS

| | | | |
|---|---|---|---|
| 3,481,851 | 12/1968 | Lancy | 204/180 P |
| 3,682,796 | 8/1972 | Bedi et al. | 204/97 |
| 3,761,369 | 9/1973 | Tirrell | 204/151 |
| 3,764,503 | 10/0973 | Lancy et al. | 204/180 P |
| 3,909,381 | 9/1975 | Ehrsam | 204/180 P |
| 4,006,067 | 2/1977 | Gussack | 204/151 |
| 4,118,295 | 10/1978 | Korenowski et al. | 204/151 |

*Primary Examiner*—Arthur C. Prescott

[57] ABSTRACT

The use of aqueous inorganic carbonates or bicarbonates as the catholyte in the electrolytic purification of chromium plating solutions permits the cell to operate at a high capacity and a high efficiency without adversely affecting the oxidation state of the chromium ions in the solution.

3 Claims, No Drawings

PURIFICATION PROCESS

FIELD OF THE INVENTION

This invention relates to a process for the electrolytic purification of chromium plating solutions. More specifically, this invention relates to a process wherein an aqueous solution of an inorganic carbonate or bicarbonate is used as the catholyte in the electrodialysis of an aqueous chromium plating solution.

BACKGROUND OF THE INVENTION

Purification of chromium plating solutions using electrodialysis is well-known in the art (see U.S. Pat. Nos. 3,481,851; 3,909,381; and 4,006,067, the disclosures of which are hereby incorporated by reference). Electrodialysis is the transport of ions through an ion permeable membrane as a result of an electrical driving force, and the process is commonly carried out in an electrodialysis cell having an anolyte compartment and a catholyte compartment separated by a permselective membrane. The permselective membranes are not unlike ion exchange resins in sheet or membrane form. They comprise a matrix of a chemically inert resin throughout the polymer lattice of which are distributed chemically bound anionic or cationic moieties having fixed negative and positive charges. Anion permeable membranes have positive (cationic) fixed charges distributed throughout the polymer lattice and, as the name implies, are permeable to negatively charged ions and are relatively impermeable to positively charged ions. Unfortunately, there are no known anion permeable membranes that are 100% impermeable to cations, and there are no known cation permeable membranes that are 100% impermeable to anions. As a result, there is always in every electrodialysis process some small degree of reverse migration of cations through the anion permeable membrane and/or of anions through the cation permeable membrane.

U.S. Pat. No. 3,481,851 teaches that the dissolved metallic contaminants can be removed from the aqueous chromium plating solution by electrodialysis. An electric current is passed between the anode and the cathode of the cell through the aqueous solutions contained in the anolyte and catholyte compartments of the cell. The electric current causes the contaminant metal cations (for example, iron and copper ions) present in the chromic acid solution to migrate from the anolyte compartment through the cation permeable membrane into the catholyte compartment, reverse migration of anions (for example, chloride ions) being prevented, in theory at least, by the cation permeable membrane. This process effectively reduces the concentration of contaminant metal cations in the chromic acid solution to acceptable levels. In addition, the electrolytic oxidizing conditions prevailing in the anolyte quickly oxidizes the trivalent chromium present therein to the hexavalent state, thereby reducing the ratio of trivalent to hexavalent chromium to an acceptable level. However, the cation permeable membrane also permits the reverse migration of a small amount of mineral acid anions from the catholyte to the anolyte compartment and as a consequence there is a fairly rapid build-up of these anions in the chromium plating solution. The build-up of mineral acid anions in the anolyte quickly renders the chromic acid solution unsuitable for chromium plating. Therefore, while this process will effectively remove harmful metal cations (for example, iron and copper ions) from the chromium plat-solution, it also results in the rapid build-up of equally harmful mineral acid anions (for example, chloride ions) in the plating solution. As a result, this process does not provide a satisfactory solution to the problem of rejuvenating chromium plating solutions by the removal of contaminant metal cations therefrom.

U.S. Pat. No. 3,909,381 teaches that the metallic contaminants can be removed from the chromium plating systems in an electrodialysis cell wherein the catholyte comprises an aqueous solution of at least one ionizable organic compound and wherein the anions of the ionizable organic compounds in the catholyte are oxidized to gaseous oxidation products and water when reacted with the chromic acid-containing anolyte thereby reducing the anion contaminants in the anolyte. However, the oxidation of the organic compound results in the reduction of hexavalent chromium to a lower valent chromium which has an adverse effect on the plating performance of the chromium solution. In addition the electrical conductivity of aqueous solutions of organic compound salts is low and, in turn, limits the capacity and electrical efficiency of the electrodialysis cell,

SUMMARY OF THE INVENTION

It has now been found that using an aqueous inorganic carbonate or bicarbonate solution as the catholyte permits the electrodialysis cell for the purification of chromium plating solutions to operate at a high capacity and a high efficiency without adversely affecting the oxidation state of the chromium ions in the solution. When the carbonate or bicarbonate ions migrate into the acidic environment of the anolyte, they are immediately converted to carbon dioxide gas, which evolves from the anolyte, and water. None of the adverse effects of the prior processes is encountered when the inorganic carbonate or bicarbonate is used in the anolyte.

DETAILED DESCRIPTION OF THE INVENTION

Any water-soluble inorganic carbonate or bicarbonate can be used in this invention. Preferred cations are the alkali metal cations and ammonium cations. Particularly preferred cations are potassium, sodium, and ammonium. The concentration of the aqueous catholyte solution of the inorganic carbonate or bicarbonate can be adjusted for the desired electrical conductivity. (Higher concentration of carbonate or bicarbonate salts gives higher electrical conductivity.) The catholyte solution of the inorganic carbonates and bicarbonates may contain chelating agents to complex and solublize the metal ions migrating from the anolyte compartment, or compounds to precipitate the metal ions. The metal ions migrating from the anolyte to the catholyte may be removed from the catholyte by precipitation and filtration and by plating on the cathode. Alkali metal hydroxides may also be added to the catholyte to encourage the precipitation of the metal ions which migrate into the catholyte.

The membranes are preferably cation exchange membranes including hydrocarbons and halocarbon polymers containing acids and acid derivatives of sulfur, carbon and phosphorus. The preferred membranes are substantially chemically stable to the process conditions, mechanically and chemically suitable for economical design and operation of the electrolytic process. Preferred for a strong oxidizing medium is the perfluorocarbon membrane, such as Nafion ®, a perfluorocarbon polymer containing sulfonic acid groups.

The following example illustrates the practice of this invention. It is presented soley for the purpose of illustrating the invention and is not in any way to be construed as limiting the scope of the invention.

A cell was assembled having an anolyte compartment containing an anode and a catholyte compartment containing a cathode with the anolyte compartment being separated from the catholyte compartment by a cation permeable membrane. The cell had an electrolysis area of 3.14 $in^{-2}$ (1 inch in diameter) and was equipped with an anode made from lead, a cathode made from 316 stainless steel. The cation membrane was Nafion ® 427 (obtained from duPont Company). To the assembled cell was added a catholyte solution comprising 10 grams of sodium carbonate, 42 grams of sodium bicarbonate in 500 ml of solution. (An aliquot of the solution was titrated with hydrochloric acid to the methyl red endpoint—the solution was 1.38 normal. An anolyte comprising 39 grams of chromium trioxide, 6 grams cupric sulfate ($CuSO_4.5H_2O$) and 3 grams sulfuric acid in 400 ml water with 0.52 grams oxalic acid added to reduce some six valent chromium to three valent chromium. The anolyte solution was brown in color. A current of three (3) amperes was applied for a period of three hours. The anolyte solution turned a deep red-orange (characteristic of chromic acid). The catholyte solution was a light blue (probably from a copper complex). Copper (0.2 g) was deposited on the cathode and 0.9 g copper calculated as cupric carbonate $CuCO_3$ was filtered from the catholyte solution. At the end of the experiment, an aliquot of the catholyte was titrated to a methly orange end point. The solution was 1.4 normal, indicating that there was substantially no transport of sodium from the catholyte to the anolyte. The membrane remained clear indicating essentially no precipitation of copper or other salts in the membrane. This example shows the ease with which chromium plating solutions can be purified by means of this invention.

I claim:

1. In the electrolytic purification of an aqueous solution of chromic acid contaminated with dissolved metallic cations by passing electric current through an electrodialysis cell comprising (a) a catholyte compartment containing a cathode and a catholyte and (b) an anolyte compartment containing an anode and an anolyte comprising a contaminated chromic acid solution the anolyte and catholyte compartments being separated by a cation-permeable membrane, the improvement comprising employing as the catholyte an aqueous solution of an inorganic carbonate or bicarbonate which forms carbon dioxide and water on contact with the anolyte, whereby a high-capacity, efficient electrodialytic purification can be carried out without adversely affecting the oxidation state of the chromium ions in the anolyte.

2. The purification according to claim 1 wherein the inorganic carbonate or bicarbonate is an alkali metal carbonate, an alkali metal bicarbonae, ammonium carbonate, or ammonium bicarbonate.

3. The purification according to claim 2 wherein the inorganic carbonate or bicarbonate is sodium carbonate, ammonium carbonate, sodium bicarbonate, potassium bicarbonate, or ammonium bicarbonate.

* * * * *